US006797321B2

(12) United States Patent
Buecher

(10) Patent No.: US 6,797,321 B2
(45) Date of Patent: Sep. 28, 2004

(54) COATING METHOD EMPLOYING SUPPLY OF PELLETS TO A HEATED SUBSTRATE

(75) Inventor: Udo Buecher, Farmborough Heights (AU)

(73) Assignee: BHP Steel Limited, NSW (AU)

( * ) Notice: Subject to any disclaimer, the term of this patent is extended or adjusted under 35 U.S.C. 154(b) by 0 days.

(21) Appl. No.: 10/203,213

(22) PCT Filed: Jan. 25, 2001

(86) PCT No.: PCT/AU01/00071

§ 371 (c)(1),
(2), (4) Date: Oct. 21, 2002

(87) PCT Pub. No.: WO01/58600

PCT Pub. Date: Aug. 16, 2001

(65) Prior Publication Data

US 2003/0113453 A1 Jun. 19, 2003

(30) Foreign Application Priority Data

Feb. 8, 2000 (AU) ..... PQ5490

(51) Int. Cl.[7] ..... B05D 3/12

(52) U.S. Cl. ..... 427/194; 427/195; 427/314; 427/318; 427/359; 427/385.5

(58) Field of Search ..... 427/194, 195, 427/314, 318, 359, 358, 385.5

(56) References Cited

U.S. PATENT DOCUMENTS 5,116,892 A * 5/1992 Barbee et al. ..... 524/99
5,407,697 A * 4/1995 Buecher et al. ..... 427/11
5,837,160 A * 11/1998 Dietz et al. ..... 252/299.01

* cited by examiner

*Primary Examiner*—Katherine A. Bareford
(74) *Attorney, Agent, or Firm*—Miles & Stockbridge P.C.; Edward J. Kondracki

(57) ABSTRACT

A method of forming a coating of a polymer-based paint composition on a substrate is disclosed. The method is based on the use of pellets rather than solid blocks of the paint composition. The method includes pre-heating a substrate to a temperature that is above the glass transition temperature of the polymer of the paint composition and supplying pellets of the paint composition to the surface of the substrate, whereby the pellets progressively melt into a liquid state. Thereafter, the method includes forming a coating of the liquid paint composition on the substrate surface and converting the liquid coating into a solid coating of the paint composition.

7 Claims, 1 Drawing Sheet

COATING METHOD EMPLOYING SUPPLY OF PELLETS TO A HEATED SUBSTRATE

CROSS REFERENCE TO RELATED APPLICATION

This application is a national stage application of PCT/AU01/00071, filed Jan. 25, 2001.

BACKGROUND OF THE INVENTION

1. Field of the Invention

The present invention relates to a method of forming a coating of a polymer-based paint composition on a substrate.

The invention relates particularly, although by no means exclusively, to a method of forming a thin ornamental and/or protective coating of a polymer-based paint composition on a moving substrate that is in the form of a metal strip.

2. Description of the Related Art

The term "thin" as used herein is understood to mean a coating thickness of up to 60 micron.

Typically, the polymer-based paint composition includes a resin, a pigment and a cross-linking agent as the main constituents.

Typically, the invention is applicable to the production of pre-painted steel strip that is used as the starting material in the production of building cladding sheets and other steel products for the building industry, appliance cabinets, vehicle bodies, and many other sheet metal products.

It is known to form a coating of a polymer-based paint composition on a steel strip by methods which are characterised by using paint compositions that are solid at ambient temperature and are in the form of solid blocks as the source of the coating. The methods include progressively melting the blocks and applying the resultant liquid paint composition to a surface of the strip. In this context, the term "liquid" is understood herein to include (a) high viscosity liquids, that may approach soft, plastic solids in nature, and (b) easily flowing liquids.

U.S. Pat. No. 5,407,697 of Buecher et al discloses one such method which includes the steps of:

(a) pre-heating a metal strip to a pre-heat temperature that is above the glass transition temperature of a thermosetting polymer-based paint composition to be coated onto a surface of the strip;

(b) moving the pre-heated strip at a pre-determined strip speed;

(c) driving a solid block of the paint composition along an axis of the block into contact with the surface of the strip to be coated to cause the paint composition to be melted from the block and applied to the surface as a liquid deposit and thereafter carried away from the block with the moving strip;

(d) forming the liquid deposit into a liquid coating of the paint composition on the surface of the strip; and (e) heating the liquid coating deposit to produce a solid coating of the paint composition covering at least part of the surface of the strip.

An object of the present invention is to provide an alternative method of forming a coating of a polymer-based paint composition on a steel strip.

SUMMARY OF THE INVENTION

In accordance with the present invention pellets rather than solid blocks of the polymer-based paint composition are used as the source of the coating on the metal strip or other suitable substrate.

The use of pellets rather than solid blocks: avoids the need to tailor block dimensions to be compatible to strip width dimensions; makes it possible to achieve more uniform application of paint across the strip; and enables transportation of larger amounts of paint than is common with solids blocks. In summary, the use of pellets rather than solid blocks enables more flexible materials handling both in transit and at the paint line.

More specifically, the present invention provides a method of forming a coating of a polymer-based paint composition on a substrate which includes the steps of:

(a) pre-heating the substrate to a temperature that is above the glass transition temperature of the polymer of the paint composition;

(b) supplying pellets of the paint composition to the surface of the substrate whereby the pellets progressively melt into a liquid state;

(c) forming a coating of the liquid paint composition on the substrate surface; and (d) converting the liquid coating into a solid coating of the paint composition.

The term "pellets" is understood herein to mean solids that have a particle size which ranges from a lower limit of 100 micron, as measured in a major dimension of the particles, to an upper limit of 5 cms, again as measured in a major dimension of the particles.

The pellets may be regular or irregular shapes.

The term "pellets" is a term that is used in the thermoplastic industry to describe solids of relatively uniform shape and size distribution that are manufactured by cutting strands of extruded material. The term "pellets" as used herein includes, but is not restricted, to this definition.

The term "pellets" is also understood herein to comprehend solids that are otherwise known as "chips" in the powder coating industry and which are of random shape and varying size distribution. The term "pellets" as used herein includes, but is not restricted to this definition, and "granules" in the thermoplastic industry.

The term "pellets" is also understood herein to exclude solids described as "powders" in the powder coating disadvantages of slow colour change-over, difficult spray booth clean-up, poor transfer efficiency onto metal strip and difficulties forming thin film coatings that are associated with spray coating technology.

The term "pellets" is also understood to exclude "blocks" of the type described, by way of example, in U.S. Pat. No. 5,407,697. In this context, the use of pellets in the subject invention requires a less complicated delivery system to that of blocks and is an advantage in this respect.

The polymer-based paint composition is selected to have appropriate properties given that the paint composition will be in the form of pellets and in many instances the pellets will be used at a different location to that at which the pellets are manufactured and will need to be transported from the manufacturing site to the end use location. Typically, the paint composition should have a glass transition temperature above the temperature experienced by pellets during transportation to avoid substantial deformation/breakdown of the pellets.

Preferably the polymer-based paint composition is a thermoset paint composition.

In situations where the paint composition is a thermoset paint composition, preferably step (d) of converting the liquid coating into the solid coating of the paint composition includes heating the liquid coating to thermoset the paint composition.

Preferably step (b) of supplying pellets of the paint composition to the surface of the substrate includes supplying pellets while the substrate is moving at a controlled speed along a pre-determined path.

Preferably the method includes controlling the deposition rate of the paint composition on the substrate for a given substrate speed by controlling the mass feed rate of pellets to the substrate.

Preferably step (c) of forming the coating of the liquid paint composition includes:

(i) positioning a roller transverse to the moving substrate so that the roller applies pressure to the surface to be coated and thereby controls the thickness of the liquid coating on the substrate; and (ii) controlling the deposition rate of the paint composition on the substrate so that a pool of liquid paint composition is established and maintained immediately upstream of the roller and is contained by the roller and the substrate.

The pool is a reservoir from which liquid paint composition is drawn by the substrate as it moves between the roller and the surface to be coated.

Step (b) of the method may include supplying pellets onto the moving substrate upstream of the pool or directly into the pool. In the latter case, and potentially in the former case, the pool will contain pellets that are in the process of melting into a liquid state.

The coating may be formed over the entire width of or part only of the width of the substrate.

BRIEF DESCRIPTION OF THE DRAWINGS

The invention is described further with reference to the accompanying drawings of which.

DETAILED DESCRIPTION OF THE PREFERRED EMBODIMENT

The following description relates to a preferred embodiment of a method of the present invention for forming a coating of a polymer-based paint composition on a substrate in the form of a steel strip. The present invention is equally applicable to other types of substrates.

Figure 1:
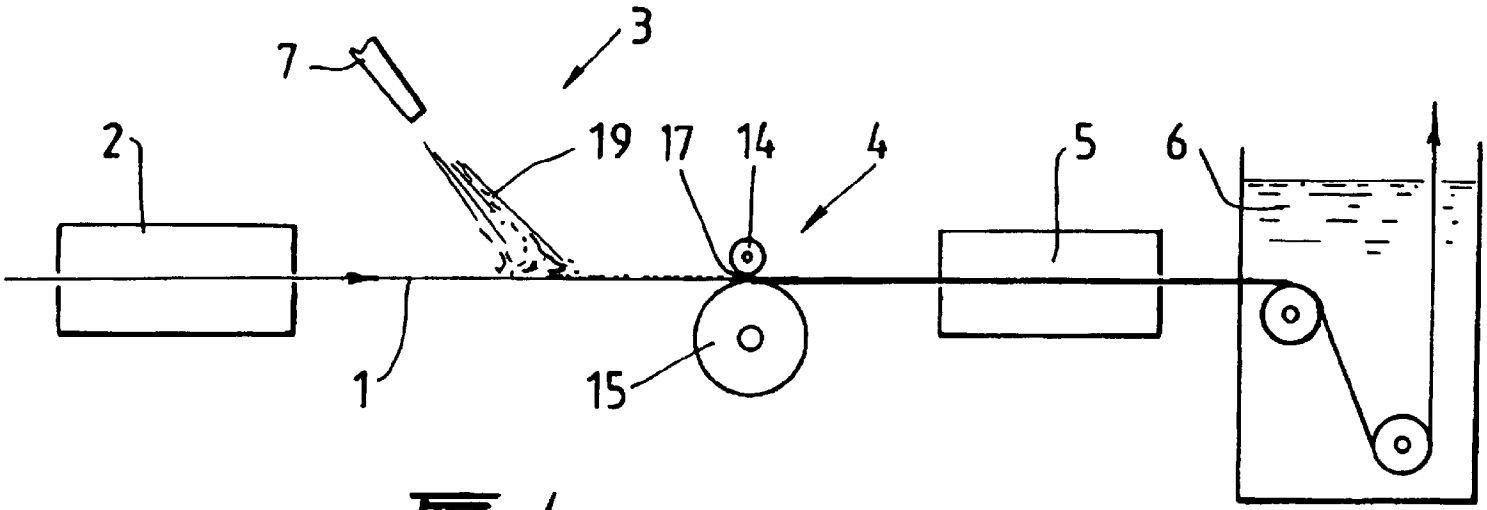
FIG. 1 is a diagrammatic side elevation of a continuous strip coating production line for carrying out one embodiment of the method of the in accordance with the present invention.

With reference to FIG. 1, a steel strip 1 which is to be continuously painted on the upper surface with a thermosetting paint composition is caused to travel sequentially through a pre-heating furnace 2, a paint coating station 3, a coating forming station 4, a curing furnace 5, and a quenching bath 6.

The illustrated paint coating line may be an integral, final part of a continuous galvanising line or may be fed from a conventional uncoiler (not shown) that is loaded with a coiled strip from stock. In either case, the coated strip emerging from the bath 6 is taken up by a conventional re-coiler (not shown) and the lines would be fitted with other conventional adjuncts, such as accumulators (not shown) and means (not shown) to maintain tension in the strip.

The incoming strip 1 is pre-treated to render it suitable for receiving a finishing coat of paint, that is to say it would be levelled, cleaned, and probably primed. All of these operations may be effected by conventional means.

The pre-heating furnace 2 heats the strip 1 to a temperature above the glass transition temperature of the polymer of the paint composition. In this context, the thermosetting paint composition may be any suitable composition which has a high solids content, typically greater than 90 wt. % solids. As discussed above, one consideration that is relevant to the issue of the suitability of the paint composition is the properties required if it is necessary to transport pellets of the paint composition from a remote pellet manufacturing site to the coating line. Typically, the pre-heated strip is in the temperature range of 160–240° C.

The paint coating station 3 comprises one guide or chute 7 or a number of guides or chutes 7 positioned above the strip 1 at spaced intervals across the width of the strip 1 which supply pellets of the paint composition in one or more streams 19 onto the upper surface of the strip. Progressively, the solid pellets of the paint composition melt into a liquid state on the surface of the strip as the strip continues to move forward. The liquid paint composition forms a series of discontinuous regions 13 (see FIG. 2) on the upper surface of the strip 1.

The coating forming station 4 spreads the discontinuous liquid deposit of paint composition over the entire strip surface. In this context, it is noted that in other embodiments the coating forming station spreads the liquid paint composition into one or more selected sections across the width of the strip.

The coating forming station 4 includes an upper pressure roll 14, with a tough, firmly resilient, smooth elastomeric surface layer, which contacts the upper surface of the strip 1 and a back-up roll 15 which contacts the lower surface of the strip 1 and provides a reaction force to the pressure roll 14.

The pressure roll 14 is power driven and may rotate in either direction. Preferably, it is rotated so that the part of its curved surface that contacts the deposit moves in the same direction as the strip 1.

The operating parameters, including the mass feed rate of pellets, is controlled so that a pool of liquid paint composition is established and maintained immediately upstream of the pressure roll 14. The pool 17, normally extends just to the edges of the strip but is very small at the edges.

Figure 2:
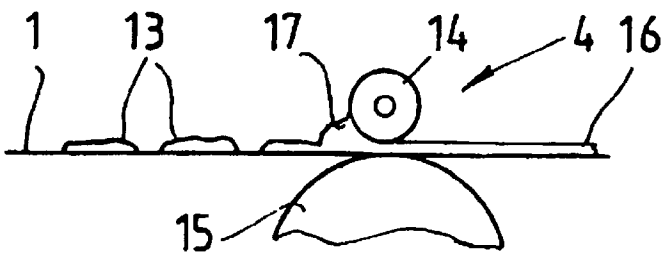
FIG. 2 is a detailed view (on a larger scale) of the paint coating station shown in FIG. 1.

With reference to FIG. 2, as the strip moves forward a coating 16 of the required pre-determined thickness across the entire surface of the strip 1 is drawn from the pool 17 and emerges from under the pressure roll 14.

Upon emerging from the coating forming station 4, the coated strip travels through the curing furnace 5, wherein the coating is heated to a curing temperature of the order of 220–270°, whereby the paint composition is converted into a solid state.

The solid coating of paint composition and the strip may then be quenched by passage through the bath 6, or otherwise cooled to room temperature for re-coiling and removal as finished product.

Many modifications may be made to the preferred embodiment of the method of the present invention described above without departing from the spirit and scope thereof.

In addition, the method of the present invention is not limited to being carried out on the coating line shown in FIGS. 1 and 2.

By way of example, the method could be carried out on a coating line that includes a different form of coating forming station 4. One alternative coating forming station (not shown) is a twin roll-based system that includes a rotating upper pressure roll which contacts the upper surface of the strip and a rotating back-up roll which contacts the pressure roll, whereby in use a pool of liquid paint composition is established and maintained at the nip between the rolls and a coating of the required pre-determined thickness is drawn from the pool and deposited onto the strip by the rotating pressure roll.

What is claimed is:

1. A method of forming a coating of a polymer-based paint composition on a moving strip substrate which includes the steps of:

(a) pre-heating the substrate to a temperature that is above the glass transition temperature of the polymer of the paint composition;

(b) supplying pellets of the paint composition to the surface of the substrate whereby the pellets progressively melt into a liquid state;

(c) forming a coating of the liquid paint composition on the substrate surface; and (d) converting the liquid coating into a solid coating of the paint composition, and wherein step (c) of forming the coating of the liquid paint composition includes:

(i) positioning a roller transverse to the moving substrate and downstream of where the pellets are supplied to the substrate so that the roller applies pressure to the surface to be coated and thereby controls the thickness of the liquid coating on the substrate; and (ii) controlling the supplying rate of the paint composition on the substrate so that a pool of liquid paint composition is established and maintained immediately upstream of the roller and is contained by the roller and the substrate.

2. The method defined in claim 1 wherein the glass transition temperature of the polymer of the paint composition is above the temperature experienced by pellets during transportation to avoid substantial deformation/breakdown of the pellets.

3. The method defined in claim 1 wherein the paint composition is a thermoset paint composition.

4. The method defined in claim 3 wherein step (d) of converting the liquid coating into the solid coating of the paint composition includes heating the liquid coating to thermoset the paint composition.

5. The method defined in claim 1 wherein step (b) of supplying pellets of the paint composition to the surface of the substrate includes supplying pellets while the substrate is moving at a controlled speed along a pre-determined path.

6. The method defined in claim 5 including controlling the deposition rate of the paint composition on the substrate for a given substrate speed by controlling the mass feed rate of pellets to the substrate.

7. The method defined in claim 1 wherein step (b) of supplying pellets of the paint composition to the surface of the substrate includes supplying pellets onto the moving substrate upstream of the pool or directly into the pool.

* * * * *